US011045852B2

(12) United States Patent
Robbins

(10) Patent No.: US 11,045,852 B2
(45) Date of Patent: Jun. 29, 2021

(54) EXTRUSION PRESS CONTAINER AND MANTLE FOR SAME

(71) Applicant: Exco Technologies Limited, Markham (CA)

(72) Inventor: Paul H. Robbins, Markham (CA)

(73) Assignee: Exco Technologies Limited, Markham (CA)

( * ) Notice: Subject to any disclaimer, the term of this patent is extended or adjusted under 35 U.S.C. 154(b) by 227 days.

(21) Appl. No.: 16/214,470

(22) Filed: Dec. 10, 2018

(65) Prior Publication Data

US 2020/0180002 A1 Jun. 11, 2020

(51) Int. Cl.
*B21C 27/00* (2006.01)
*B21C 29/02* (2006.01)

(52) U.S. Cl.
CPC ..... *B21C 27/00* (2013.01); *B21C 29/02* (2013.01)

(58) Field of Classification Search
CPC ..... B21C 29/02; B21C 23/21; B21C 23/212; B21C 23/214; B21C 27/00; B21C 27/02; B21C 27/04; B21C 29/00; B21C 9/00; B21C 9/005; B21C 9/02; B21C 23/32; B21C 29/04
See application file for complete search history.

(56) References Cited

U.S. PATENT DOCUMENTS 1,715,936 A * 6/1929 Madden ..... B21C 29/02 72/272
2,820,132 A * 1/1958 Krause ..... B21C 27/00 219/422
9,815,102 B2 * 11/2017 Robbins ..... B21C 27/00
2005/0262913 A1 * 12/2005 Robbins ..... B21C 29/02 72/272
2014/0174143 A1 * 6/2014 Robbins ..... B21C 29/02 72/272

FOREIGN PATENT DOCUMENTS

CN 108480413 A * 9/2018

* cited by examiner

*Primary Examiner* — Shelley M Self
*Assistant Examiner* — Jared O Brown

(57) ABSTRACT

A container for use in a metal extrusion press has a longitudinal axis, the longitudinal axis being oriented generally horizontally and dividing the container into an upper portion and a lower portion when the container is in the use position. The container comprises: a mantle comprising an elongate body having an outer surface and an axial bore therein; an elongate liner accommodated within the axial bore, the liner comprising a longitudinally extending passage therein through which a billet is advanced; a first fluid channel adjacent an outer surface of the mantle, the first fluid channel being configured to direct a first fluid therethrough for cooling a first end of the container; and a second fluid channel adjacent an outer surface of the mantle, the second fluid channel being configured to direct a second fluid therethrough for cooling a second end of the container.

20 Claims, 11 Drawing Sheets

EXTRUSION PRESS CONTAINER AND MANTLE FOR SAME

FIELD OF THE INVENTION

The present invention relates generally to extrusion and in particular, to an extrusion press container and a mantle for same.

BACKGROUND OF THE INVENTION

Metal extrusion presses are well known in the art, and are used for forming extruded metal products having cross-sectional shapes that generally conform to the shape of the extrusion dies used. A typical metal extrusion press comprises a generally cylindrical container having an outer mantle and an inner tubular liner. The container serves as a temperature controlled enclosure for a billet during extrusion. An extrusion ram is positioned adjacent one end of the container. The end of the extrusion ram abuts a dummy block, which in turn abuts the billet allowing the billet to be advanced through the container. An extrusion die is positioned adjacent the opposite end of the container.

During operation, once the billet is heated to a desired extrusion temperature (typically 800-900° F. for aluminum), it is delivered to the extrusion press. The extrusion ram is then activated to abut the dummy block thereby advancing the billet into the container and towards the extrusion die. Under the pressure exerted by the advancing extrusion ram and dummy block, the billet is extruded through the profile provided in the extrusion die until all or most of the billet material is pushed out of the container, resulting in the extruded product.

In order to attain cost-saving efficiency and productivity in metal extrusion technologies, it is important to achieve thermal alignment of the extrusion press. Thermal alignment is generally defined as the control and maintenance of optimal running temperature of the various extrusion press components. Achieving thermal alignment during production of extruded product ensures that the flow of the extrudable material is uniform, and enables the extrusion press operator to press at a higher speed with less waste.

As will be appreciated, optimal billet temperature can only be maintained if the container can immediately correct any change in the liner temperature during the extrusion process, when and where it occurs. Often all that is required is the addition of relatively small amounts of heat to areas that are deficient.

A number of factors must be considered when assessing the thermal alignment of an extrusion press. For example, the whole of the billet of extrudable material must be at the optimum operating temperature in order to assure uniform flow rates over the cross-sectional area of the billet. The temperature of the liner in the container must also serve to maintain, and not interfere with, the temperature profile of the billet passing therethrough.

Achieving thermal alignment is generally a challenge to an extrusion press operator. During extrusion, the top of the container usually becomes hotter than the bottom. Although conduction is the principal method of heat transfer within the container, radiant heat lost from the bottom surface of the container rises inside the container housing, leading to an increase in temperature at the top. As the front and rear ends of the container are generally exposed, they will lose more heat than the center section of the container. This may result in the center section of the container being hotter than the ends. As well, the temperature at the extrusion die end of the container tends to be slightly higher compared to the ram end, as the billet heats it for a longer period of time. These temperature variations in the container affect the temperature profile of the liner contained therein, which in turn affects the temperature of the billet of extrudable material. The temperature profile of the extrusion die generally conforms to the temperature profile of the liner, and the temperature of the extrusion die affects the flow rate of extrudable material therethrough. Although the average flow rate of extrudable material through the extrusion die is governed by the speed of the ram, flow rates from hotter sections of the billet will be faster compared to cooler sections of the billet. The run-out variance across the cross-sectional profile of a billet can be as great as 1% for every 5° C. difference in temperature. This can adversely affect the shape of the profile of the extruded product. Control of the temperature profiles of the liner and of the container is therefore of great importance to the efficient operation of the extrusion process.

One approach to achieving such temperature profile control of the liner and the container involves introducing cooling to the container. Cooling in extrusion press containers has been previously described. For example, U.S. Pat. No. 5,678,442 to Ohba et al. describes an extruder having a cylindrical container into which a billet is loaded; a two-piece seal block disposed on an end surface of the container at an extruding stem side; a vacuum deaerating hole formed in the seal block; and a fixed dummy block, having an internal cooling function, fixed to an end of the extruding stem, wherein the seal block is allowed to be opened and closed in a direction perpendicular to the axial direction of the container and the seal block comes in close contact with an outer surface of the extruding stem and the end surface of the container when the seal block is closed.

Japanese Patent Application No. 2010115664 to Ube Machinery Corporation Ltd. describes a container device of an extruding press, the container device being provided with a heating means on an outer peripheral surface and an end face, and divided into an upper part and a lower part in the radial direction and in a plurality of places in the length direction, the temperature of which is made freely controllable respectively in each divided zone. The container device also has an internal cooling means, for enabling the temperature to be freely controlled respectively independently in the upper and lower parts into which the container is divided.

Chinese Patent Document No. 202185474 to Wei describes a cooling and controlling device for extrusion cylinders, comprising an extrusion cylinder sleeve, an extrusion cylinder middle lining and an extrusion cylinder inner lining. The extrusion cylinder middle lining is provided with a spiral cooling groove. The spiral cooling groove is divided into four areas which are respectively in communication with a compressed air inlet and a compressed air outlet. The compressed air inlet is in communication with a compressed air source through an air inlet pipe joint, and the compressed air outlet is in communication with a silencing device through a vent pipe joint. A compressed air control system is connected between the compressed air source and the air inlet pipe joint.

U.S. Pat. No. 9,815,102 to Robbins describes a container for use in a metal extrusion press comprising a mantle having an elongate body comprising an axial bore, an elongate liner accommodated within the axial bore, the liner comprising a longitudinally extending passage through which a billet is advanced, and a fluid channel in thermal communication with the mantle through which a fluid for cooling the container flows.

Improvements are generally desired. It is therefore an object at least to provide a novel extrusion press container and a mantle for same.

SUMMARY OF THE INVENTION

It should be appreciated that this summary is provided to introduce a selection of concepts in a simplified form that are further described below in the detailed description. This summary is not intended to be used to limit the scope of the claimed subject matter.

In one aspect, there is provided a container for use in a metal extrusion press, the container having a longitudinal axis, the longitudinal axis being oriented generally horizontally and dividing the container into an upper portion and a lower portion when the container is in the use position, the container comprising: a mantle comprising an elongate body having an outer surface and an axial bore therein; an elongate liner accommodated within the axial bore, the liner comprising a longitudinally extending passage therein through which a billet is advanced; a first fluid channel adjacent an outer surface of the mantle, the first fluid channel being configured to direct a first fluid therethrough for cooling a first end of the container; and a second fluid channel adjacent an outer surface of the mantle, the second fluid channel being configured to direct a second fluid therethrough for cooling a second end of the container.

The second fluid may be water.

The first fluid and the second fluid may be different fluids. The first fluid may be air, and the second fluid may be water.

The mantle may comprise a plurality of longitudinal bores, each of the bores accommodating a respective heating element. The heating elements may be arranged circumferentially about the central axial bore of the mantle. The container may further comprise at least one longitudinal temperature sensor positioned in the mantle adjacent at least one of the first fluid channel and the second fluid channel. The at least one longitudinal temperature sensor may be positioned between the longitudinal bores and said at least one of the first fluid channel and the second fluid channel.

The first fluid channel may comprise a groove disposed on the outer surface of the mantle. The groove may be a serpentine groove. The first fluid channel may further comprise a cover plate covering the groove.

The second fluid channel may comprise tubing disposed on the outer surface of the mantle. The tubing may be disposed in a groove formed on the outer surface of the mantle. The groove may be a serpentine groove.

The container may further comprise a manifold configured for one or more of: delivering fluid to at least one of the first fluid channel and the second fluid channel; and removing fluid from at least one of the first fluid channel and the second fluid channel.

The container may further comprise a longitudinal temperature sensor positioned in the mantle adjacent at least one of the first fluid channel and the second fluid channel.

In another aspect, there is provided a mantle for a container for use in a metal extrusion press, the mantle comprising: an elongate body having an outer surface and an axial bore therein, the axial bore configured to accommodate an elongate liner comprising a longitudinally extending passage therein through which a billet is advanced; a first fluid channel adjacent an outer surface of the mantle, the first fluid channel being configured to direct a first fluid therethrough for cooling a first end of the container; and a second fluid channel adjacent an outer surface of the mantle, the second fluid channel being configured to direct a second fluid therethrough for cooling a second end of the container.

In still another aspect, there is provided a container for use in a metal extrusion press, the container comprising: a mantle comprising an elongate body having an outer surface and a first axial bore therein; an elongate subliner accommodated within the first axial bore, the subliner having a second axial bore therein; an elongate liner accommodated within the second axial bore, the liner comprising a longitudinally extending passage therein through which a billet is advanced; a first fluid channel adjacent an outer surface of the mantle, the first fluid channel being configured to direct a first fluid therethrough for cooling a first end of the container; and a second fluid channel adjacent an outer surface of the mantle, the second fluid channel being configured to direct a second fluid therethrough for cooling a second end of the container.

The subliner may comprise a plurality of longitudinal bores, each of the bores accommodating a respective heating element.

The container may further comprise at least one longitudinal temperature sensor positioned in the mantle adjacent at least one of the first fluid channel and the second fluid channel.

BRIEF DESCRIPTION OF THE DRAWINGS

Embodiments will now be described more fully with reference to the accompanying drawings in which.

DETAILED DESCRIPTION OF THE EMBODIMENTS

The foregoing summary, as well as the following detailed description of certain examples will be better understood when read in conjunction with the appended drawings. As used herein, an element or feature introduced in the singular and preceded by the word "a" or "an" should be understood as not necessarily excluding the plural of the elements or features. Further, references to "one example" or "one embodiment" are not intended to be interpreted as excluding the existence of additional examples or embodiments that also incorporate the described elements or features. Moreover, unless explicitly stated to the contrary, examples or embodiments "comprising" or "having" or "including" an element or feature or a plurality of elements or features having a particular property may include additional elements or features not having that property. Also, it will be appreciated that the terms "comprises", "has", "includes" means "including by not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of description to describe the relationship of an element or feature to another element or feature as illustrated in the figures. The spatially relative terms can however, encompass different orientations in use or operation in addition to the orientation depicted in the figures.

Figure 1:
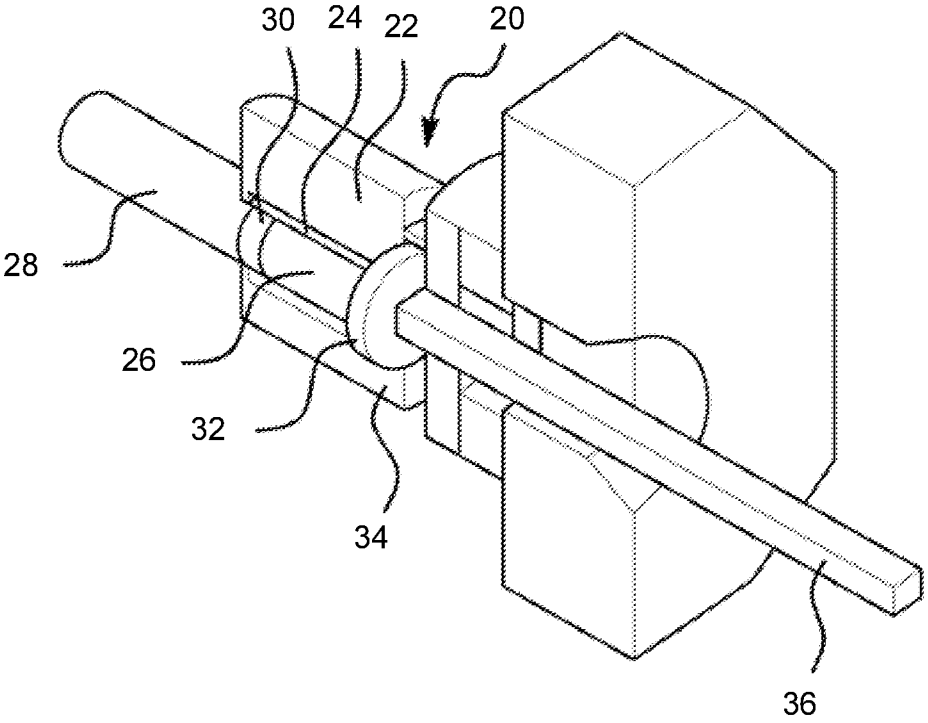
FIG. 1 is a schematic perspective view of a metal extrusion press.
Figure 2:
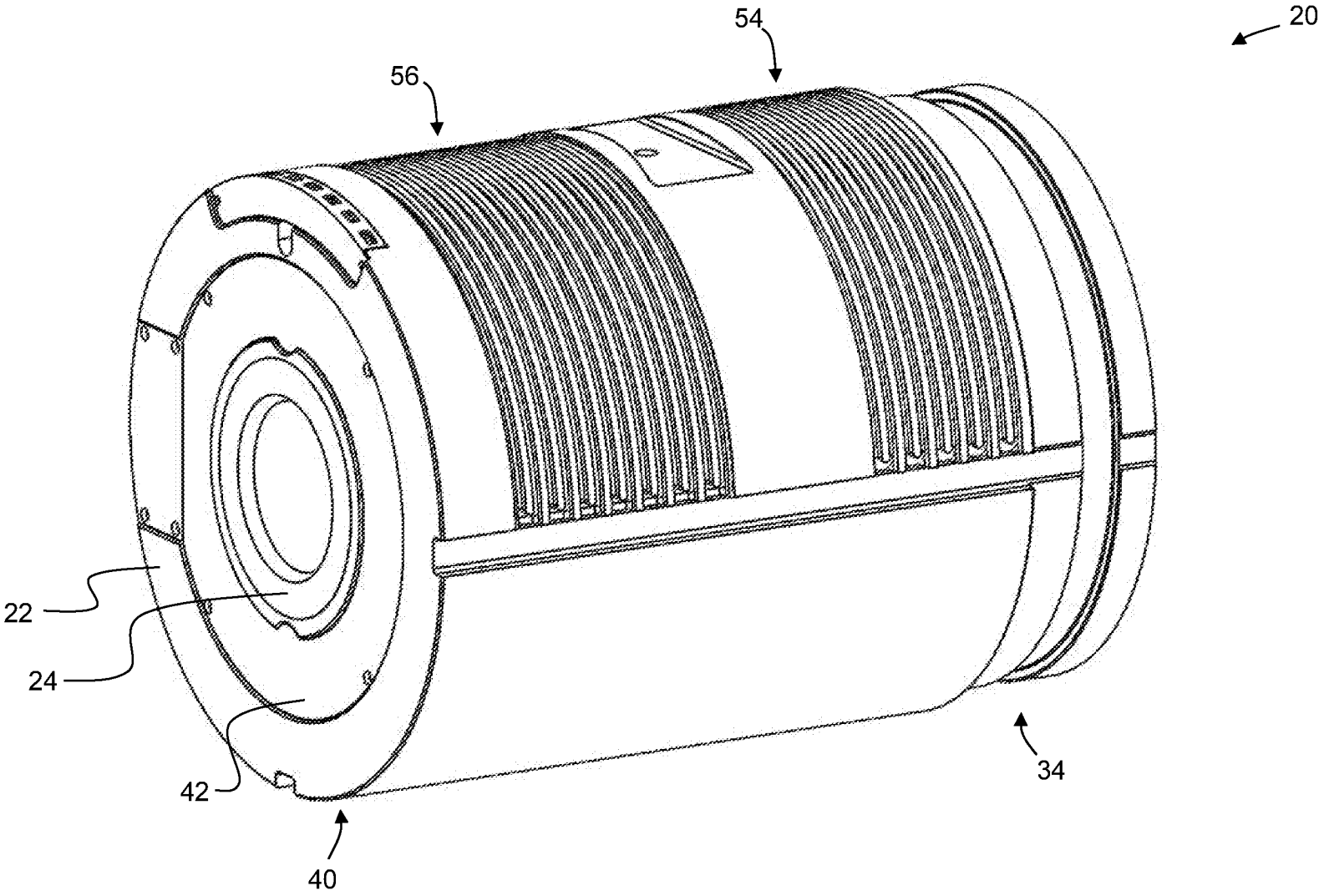
FIG. 2 is a perspective view of a container forming part of the metal extrusion press of FIG. 1.
Figure 3:
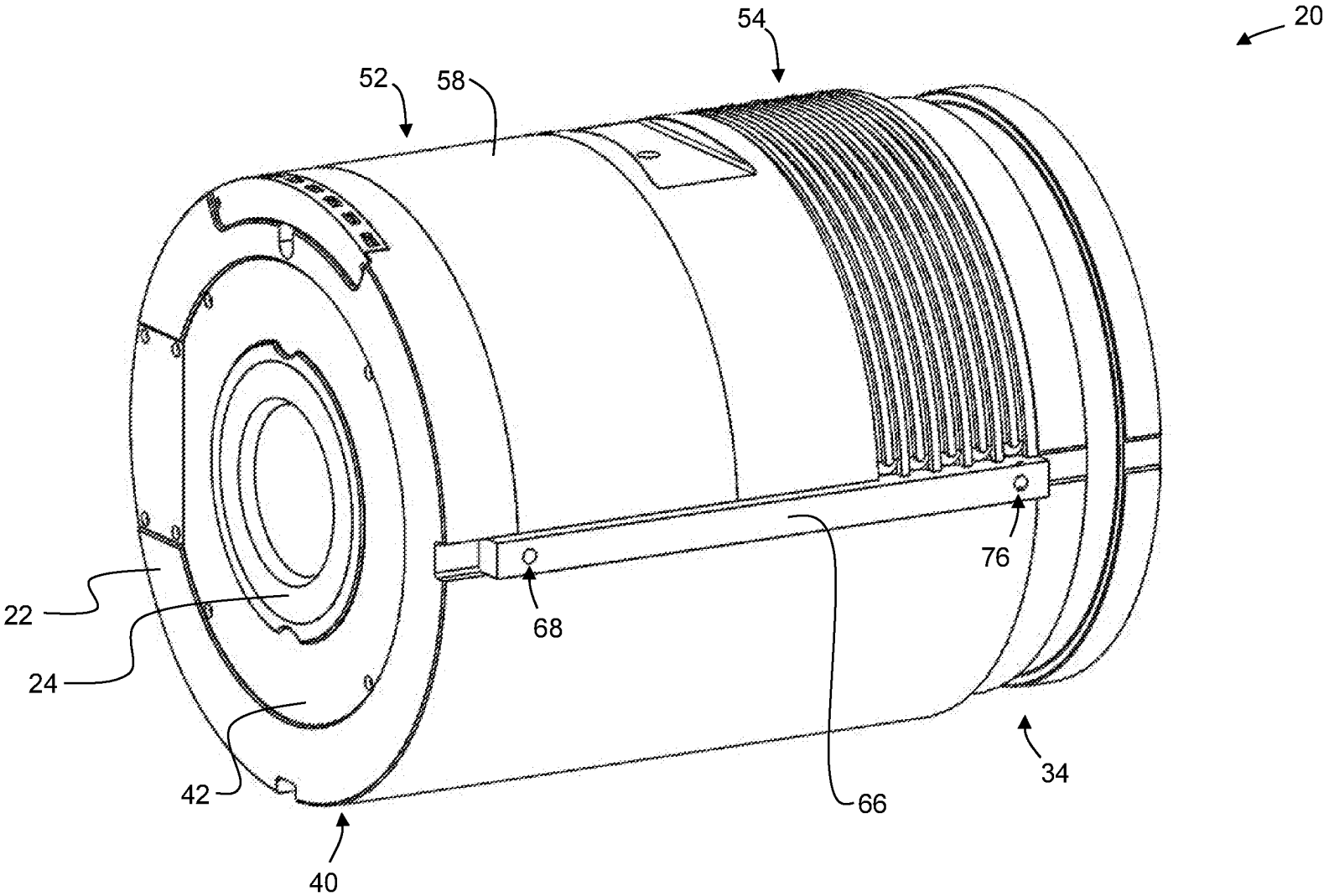
FIG. 3 is a perspective view of the container of FIG. 2, in a use configuration.
Figure 4:
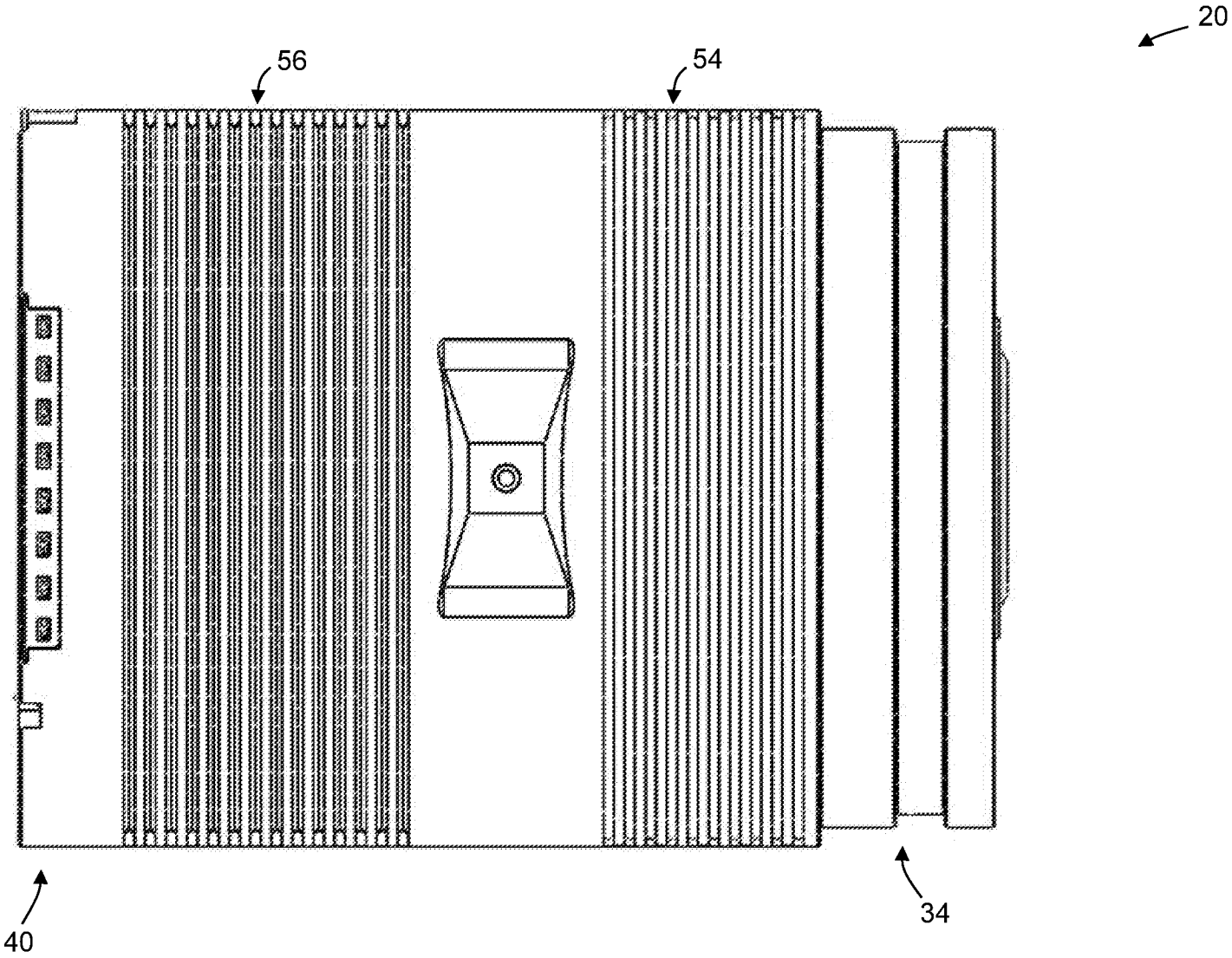
FIG. 4 is a top view of the container of FIG. 2.
Figure 5:
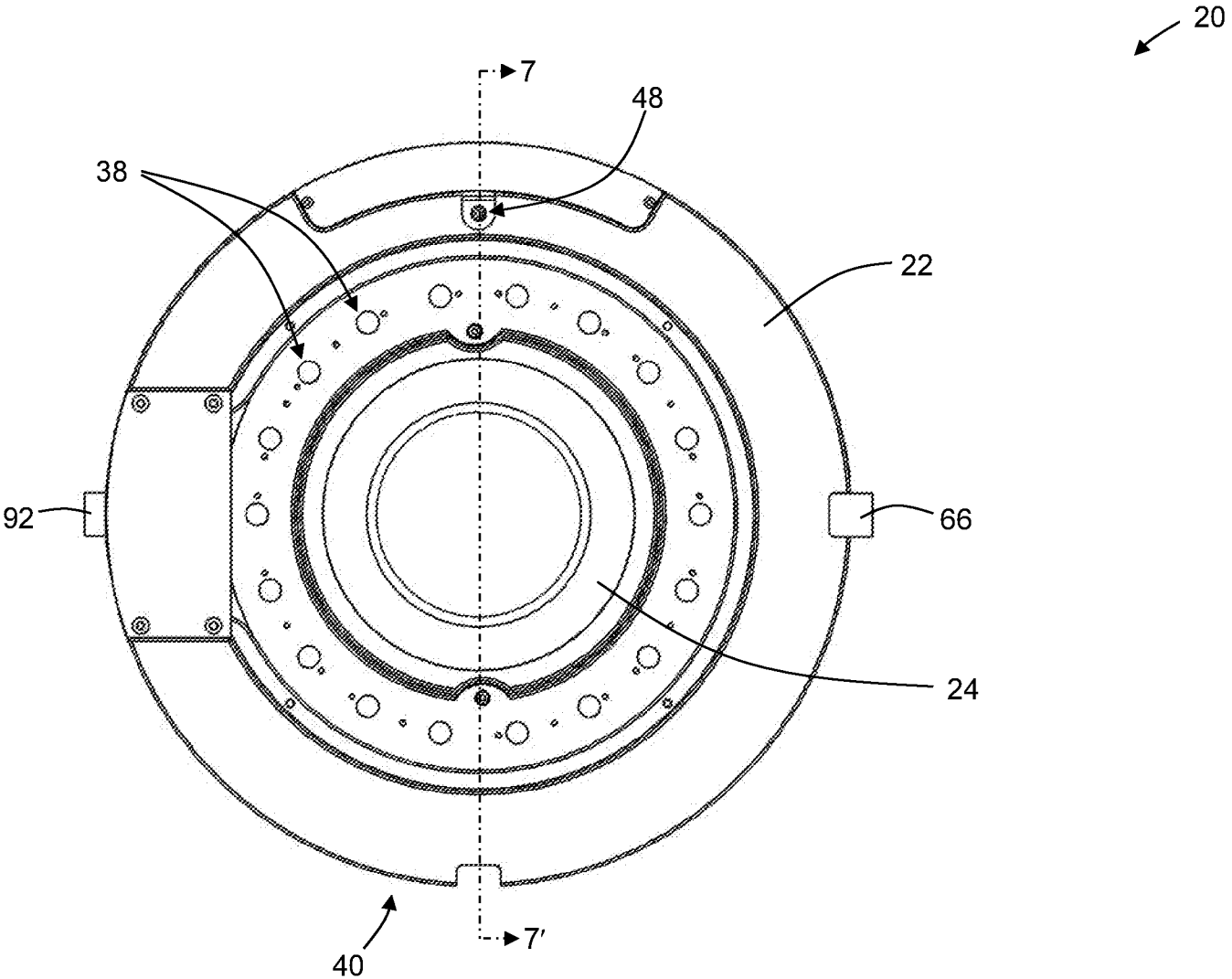
FIG. 5 is an end view of the container of FIG. 2
Figure 6:
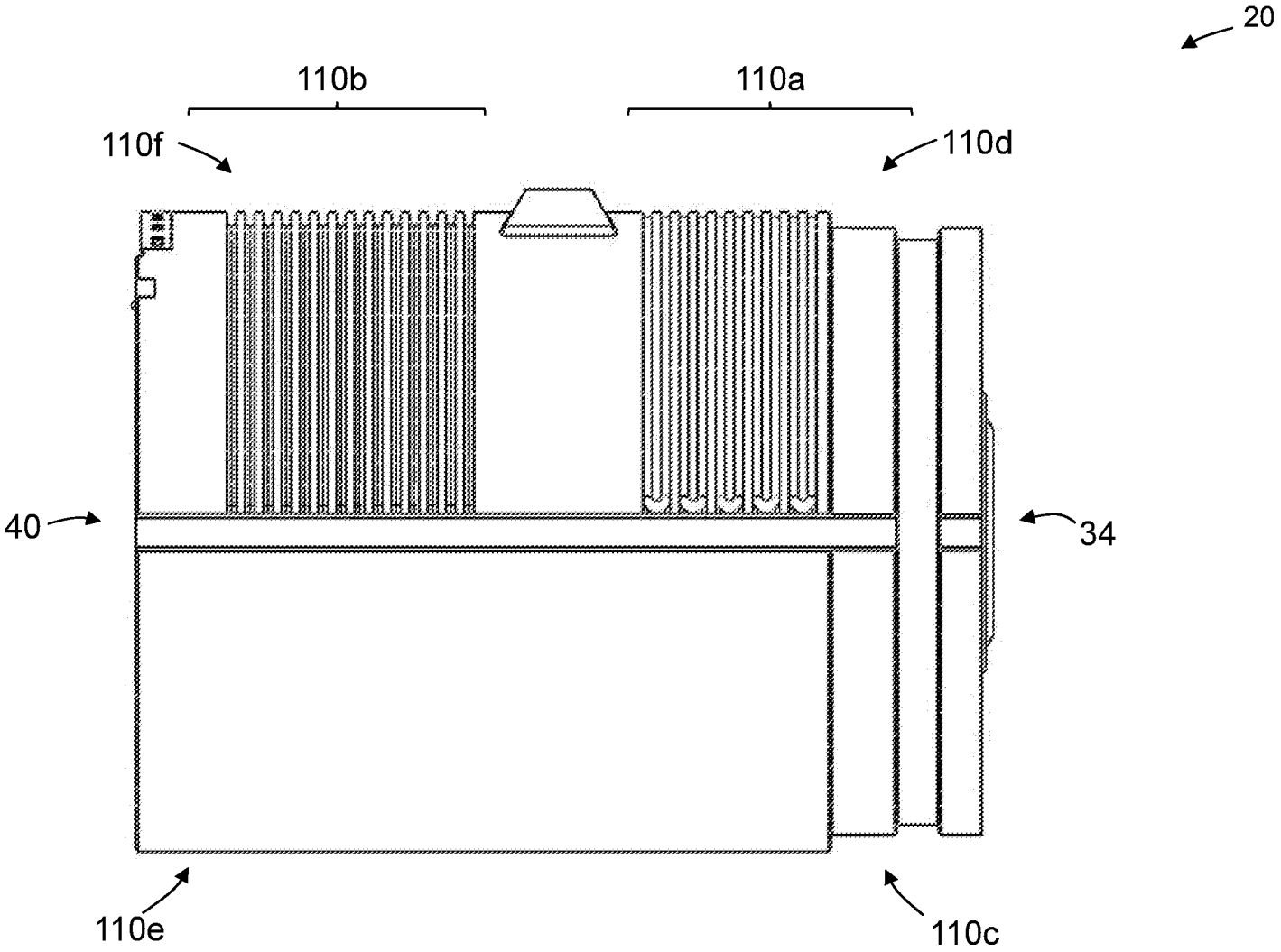
FIG. 6 is a side view of the container of FIG. 2.
Figure 7:
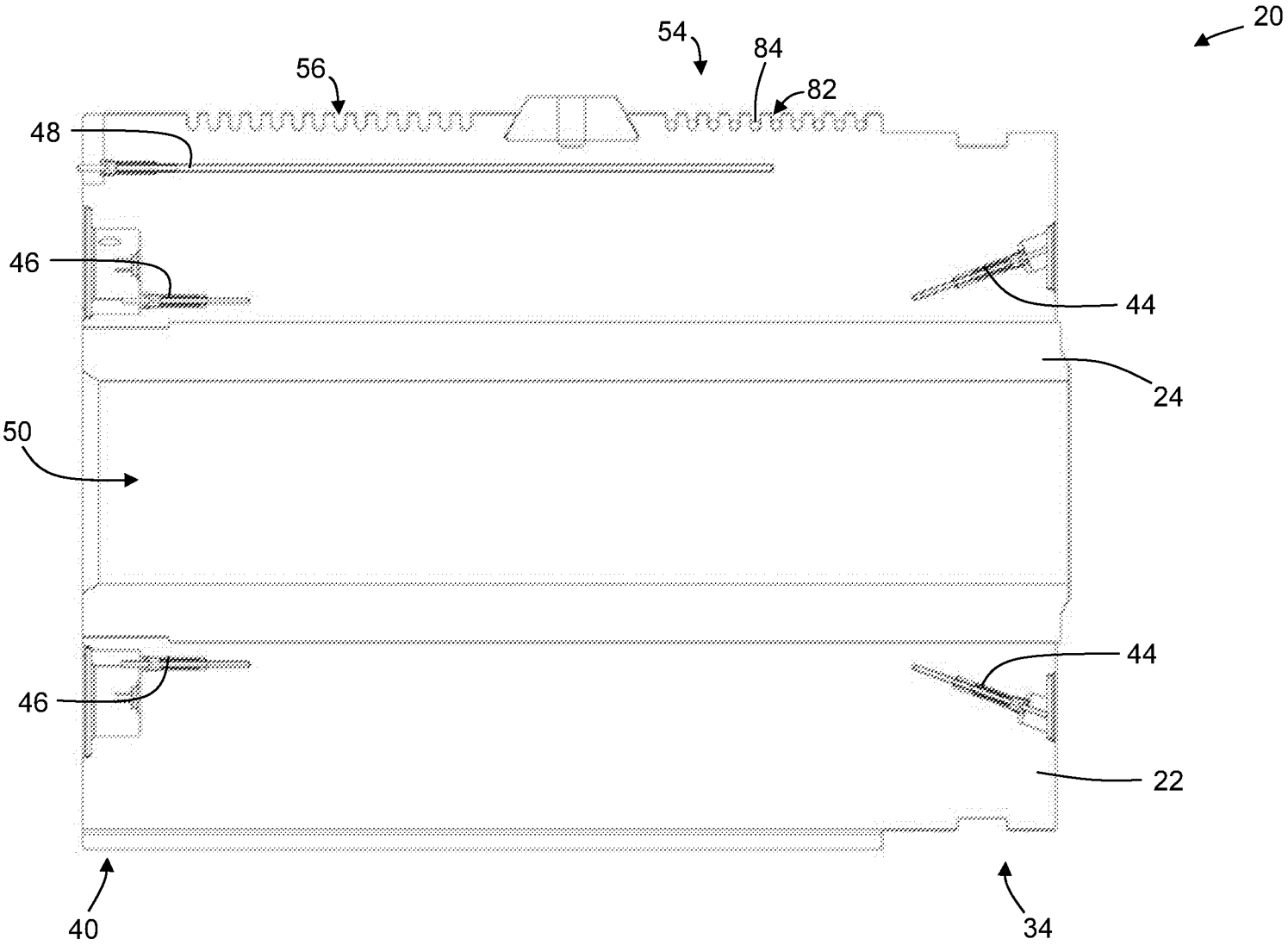
FIG. 7 is a sectional view of the container of FIG. 5, taken along the indicated section line.
Figure 8:
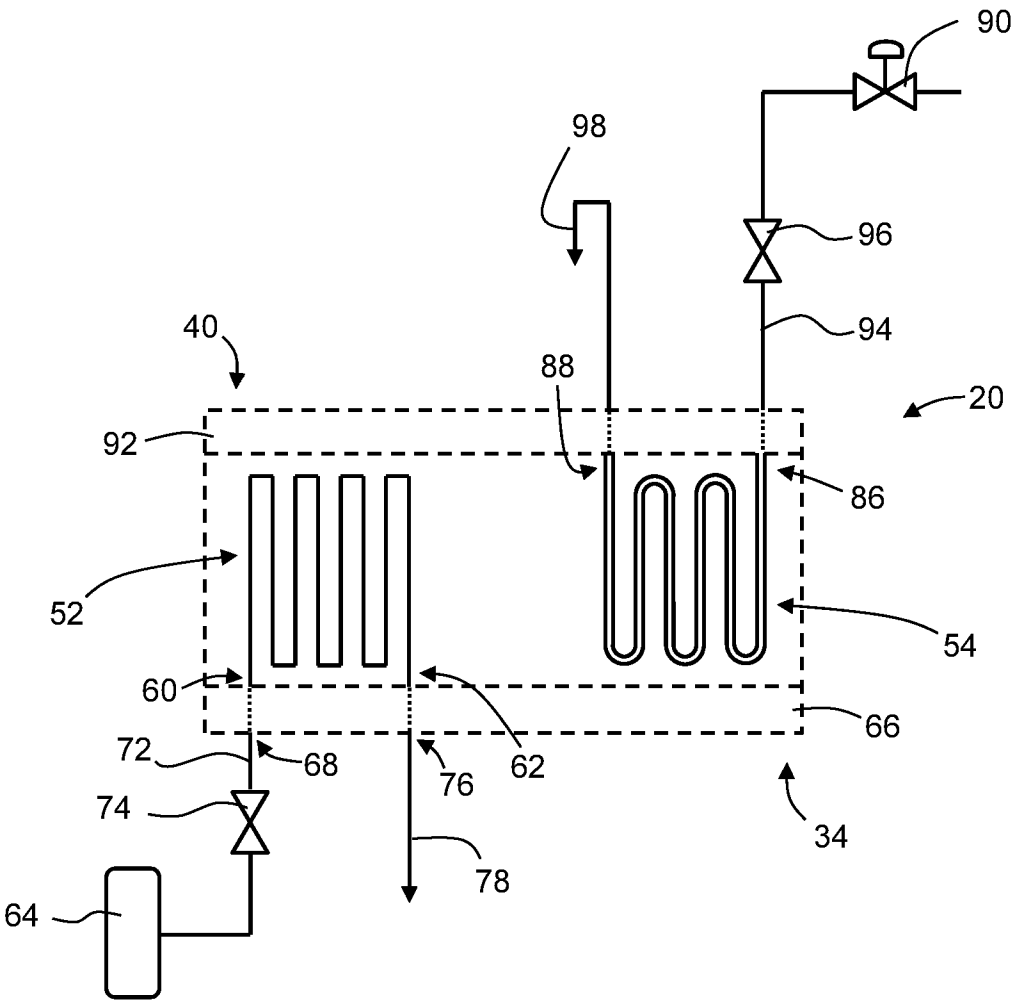
FIG. 8 is a schematic view of the container of FIG. 2.

FIG. 1 is a simplified illustration of an extrusion press for use in metal extrusion. The extrusion press comprises a container 20 having an outer mantle 22 that surrounds an inner tubular liner 24. The container 20 serves as a temperature controlled enclosure for a billet 26 during extrusion of the billet. An extrusion ram 28 is positioned adjacent one end of the container 20. The end of the extrusion ram 28 abuts a dummy block 30, which in turn abuts the billet 26 allowing the billet to be advanced through the container 20. An extrusion die 32 is positioned adjacent a die end 34 of the container 20.

During operation, once the billet 26 is heated to a desired extrusion temperature (typically 800-900° F. for aluminum), it is delivered to the extrusion press. The extrusion ram 28 is then actuated to abut the dummy block 30, thereby to advance the billet 26 into the container and towards the extrusion die 32. Under the pressure exerted by the advancing extrusion ram 28 and dummy block 30, the billet 26 is extruded through the profile provided in the extrusion die 32 until all or most of the billet material is pushed out of the container 20, resulting in the extruded product 36.

The container 20 may be better seen in FIGS. 2 to 8. The container 20 is configured at the die end 34, and along the side sections thereof, in a manner known in the art to facilitate coupling of the container 20 to the extrusion press. The mantle 22 has a generally cylindrical shape and comprises an axial bore accommodating the liner 24. In this embodiment, the mantle 22 and the liner 24 are shrunk-fit together.

The mantle 22 comprises a plurality of longitudinal bores 38 extending from a ram end 40 of the mantle 22 to the die end 34 of the mantle 22, and surrounding the liner 24. Each longitudinal bore 38 is shaped to accommodate an elongate heating element, further described below, that can be energized to provide thermal energy to the mantle 22 in the vicinity of the liner 24 during use. The number of longitudinal bores 38 needed depends on the size of the container 20 and on the voltage used to energize the elongate heating elements. In this embodiment, the mantle 22 comprises eighteen (18) longitudinal bores 38. The container 20 has an end cover plate 42 installed on its die end 34 that covers the ends of the longitudinal bores 38.

The mantle 22 also comprises a plurality of bores 44 and 46 adjacent the liner 24 and extending partially into the length of the mantle 22. In this embodiment, the mantle 22 comprises two (2) bores 44 extending from the die end 34 approximately four (4) inches into the mantle 22, and two (2) bores 46 extending from the ram end 40 approximately four (4) inches into the mantle 22. Each bore 44 and 46 is shaped to accommodate a temperature sensor (not shown). The bores 44 and 46 are positioned in a manner so as to avoid intersecting any of the longitudinal bores 38 configured for accommodating the heating elements. In this embodiment, one (1) of the bores 44 is positioned above the liner 24 while the other bore 44 is positioned below the liner 24, and one (1) of the bores 46 is positioned above the liner 24 while the other bore 46 is positioned below the liner 24. The mantle 22 also comprises a longitudinal bore 48 in an upper portion of the mantle, radially outward of the nearest longitudinal bore 38. The bore 48 extends from the ram end 40 approximately sixteen (16) inches into the mantle 22, or approximately two thirds (⅔) the length of the mantle 22. The bore 48 is sized to accommodate two (2) temperature sensors (not shown), each of which is positioned in proximity to a respective heat sink, described below.

The liner 24 comprises a billet receiving passage 50 that extends longitudinally therethrough and, in the embodiment shown, the passage 50 has a generally circular cross-sectional profile.

The container 20 also comprises two (2) heat sinks that are configured for cooling the container 20. In this embodiment, the heat sinks comprise a first fluid channel 52 adjacent the ram end 40 of the container 20, and a second fluid channel 54 adjacent the die end 34 of the container 20. The first fluid channel 52 and second fluid channel 54 are separate, and are not in fluid communication with each other.

The first fluid channel 52 comprises a first circumferential groove 56 formed in an upper portion of the outer surface of the mantle 22 adjacent the ram end 40, and a cover plate 58 sized to cover the first circumferential groove 56. The first circumferential groove 56 has a first end 60 and a second end 62, and defines a serpentine path between the first and second ends 60 and 62. The first circumferential groove 56 is formed such that at least a majority of its length is formed in the upper half of the mantle 22, and in the embodiment shown the entirety of the first circumferential groove 56 is formed in the upper half of the mantle 22. Additionally, the first circumferential groove 56 is formed such that at least a majority of its length is formed in the half of the mantle 22 at the ram end 40, and in the embodiment shown the entirety of the first circumferential groove 56 is formed in the half of the mantle 22 at the ram end 40. When the cover plate 58 is installed so as to cover the first circumferential groove 56, the first fluid channel 52 provides a generally enclosed, continuous channel through which a first fluid flows to cool the container 20.

The first fluid channel 52 is in fluid communication with a supply 64 of pressurized first fluid via a first longitudinal fluid manifold 66 mounted to a first side of the mantle 22. The manifold 66 comprises a first fluid input port 68 that is in fluid communication with the first end 60 of the first circumferential groove 56, and that is also in fluid communication with the supply 64 of pressurized first fluid via a supply line 72. The first fluid is a gas, and in this embodiment the first fluid is air. A first flow rate control apparatus 74 is connected to the supply 64 of pressurized first fluid and/or the supply line 72, and is configured to allow the flow rate of first fluid entering the first fluid input port 68 to be controlled by the operator. The manifold 66 also comprises a first fluid output port 76 that is in fluid communication with the second end 62 of the first circumferential groove 56, and which is in fluid communication with an exhaust line 78.

The second fluid channel 54 comprises a second circumferential groove 82 formed in the upper portion of the outer surface of the mantle 22 adjacent the die end 34 of the container 20, and continuous tubing 84 sized to be accommodated within the second circumferential groove 82. In the example shown, the second circumferential groove 82 is a continuous groove that defines a serpentine path. The tubing 84 has a first end 86 and a second end 88, and is disposed in the second circumferential groove 82 to define a serpentine path between the first and second ends 86 and 88. Similar to the first circumferential groove 56, the second circumferential groove 82 is configured such that at least a majority of the length of the tubing 84 is disposed in the upper half of the mantle 22, and in the embodiment shown the entirety of the length of the tubing 84 is disposed in the upper half of the mantle 22. Additionally, the first circumferential groove 56 is formed such that at least a majority of its length is formed in the half of the mantle 22 at the die end 34, and in the embodiment shown the entirety of the first circumferential groove 56 is formed in the half of the mantle 22 at the die end 34. The tubing 84 is configured to convey a second fluid therethrough to cool the container 20.

The second fluid channel 54 is in fluid communication with a supply 90 of pressurized second fluid via a second longitudinal fluid manifold 92 mounted to a second side of the mantle 22. The manifold 92 comprises a second fluid input port (not shown) that is in fluid communication with the first end 86 of the tubing 84, and that is also in fluid communication with the supply 90 of second fluid via a supply line 94. In this embodiment, the second fluid is water. A second flow rate control apparatus 96 is connected to the supply of second fluid and/or the supply line, and is configured to allow the flow rate of second fluid entering the manifold 92 to be controlled by the operator. The manifold 92 also comprises a second fluid output port (not shown) that is in fluid communication with the second end 88 of the continuous tubing 84, and which is in fluid communication with a second fluid discharge 98. In this embodiment, the second fluid discharge 98 is a drain.

Figure 9:
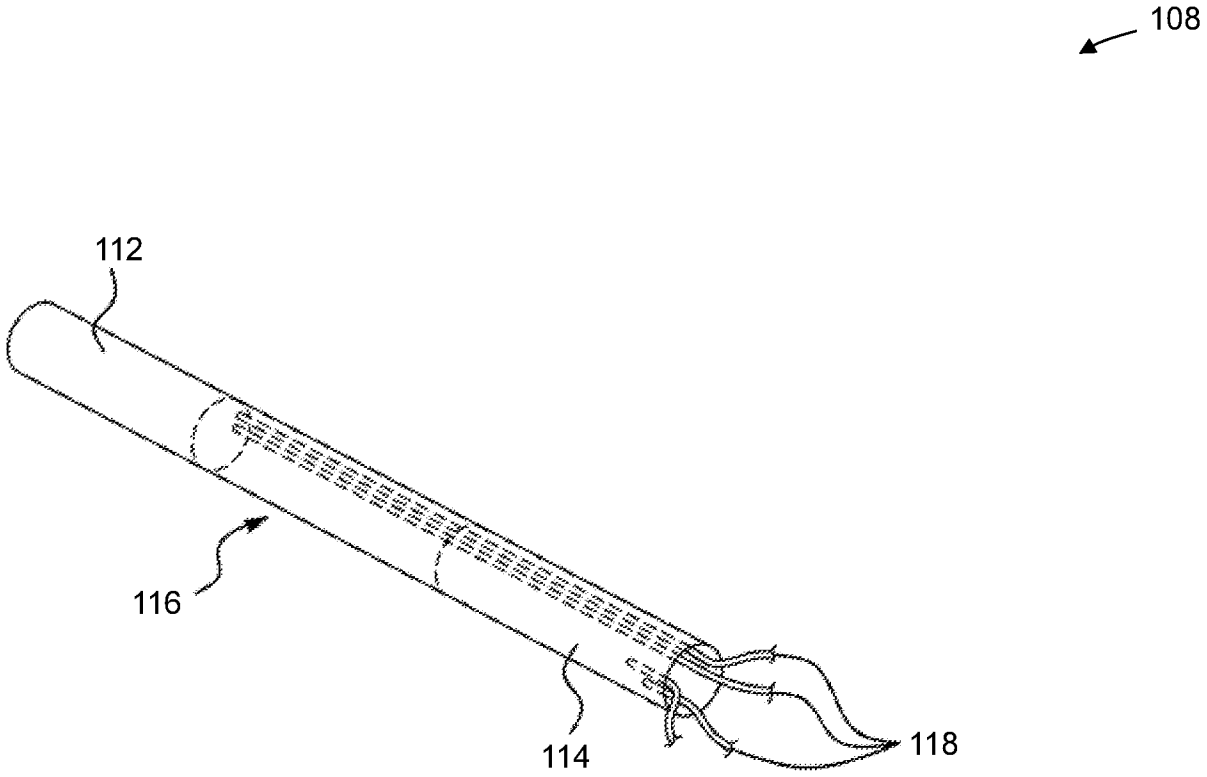
FIG. 9 is a perspective view of a heating element for use with the container of FIG. 2.

FIG. 9 shows one of the elongate heating elements for use with the container 20, and which is generally indicated by reference numeral 108. Heating element 108 is a cartridge-type element. The regions of the container in greatest need of added temperature are generally the die end 34 and ram end 40, referred to as die end zone 110*a* and ram end zone 110*b*, respectively. As such, each heating element 108 may be configured with segmented heating regions. In this embodiment, and as shown in FIG. 9, each heating element 108 is configured with a die end heating section 112 and a ram end heating section 114, which are separated by a central unheated section 116. To energize and control the heating elements, lead lines 118 feed to each heating section 112, 114. The lead lines connect to various bus lines (not shown), which in turn connect to a controller (not shown). The arrangement of the bus lines may take any suitable configuration, depending on the heating requirements of the container 20. In this embodiment, the bus lines are configured to selectively allow heating of the die end zone 110*a* and ram end zone 110*b* of the container, or more preferably just portions thereof, as deemed necessary by the operator. In this embodiment, the arrangement of lead lines enables each of the heating elements 108 to be individually controllable, and also enables each of the heating sections 112, 114 within each heating element 108 to be individually controllable. For example, the operator may routinely identify temperature deficiencies in a lower die end zone 110*c* and a lower ram end zone 110*e*. The elongate heating elements 108 in the vicinity of the lower die end zone 110*c* and the lower ram end zone 110*e* are configured to be controlled by the operator to provide added temperature when required. Similarly, the elongate heating elements 108 in the vicinity of an upper die end zone 110*d* and an upper ram end zone 110*f* are configured to be controlled by the operator to provide reduced temperature when required. It will also be appreciated that the operator can selectively heat zones so as to maintain a preselected billet temperature profile. For example, the operator may choose a billet temperature profile in which the temperature of the billet progressively increases towards the die end, but with a constant temperature profile across the cross-sectional area of the billet. This configuration is generally referred to as a "tapered" profile. Having the ability to selectively heat zones where necessary enables the operator to tailor and maintain a preselected temperature profile, ensuring desired productivity.

Each temperature sensor (not shown) is configured to monitor the temperature of the container during operation. The positioning of the two (2) bores 44 enables one (1) temperature sensor to be placed in the upper die end zone 110*d*, and one (1) temperature sensor to be placed in the lower die end zone 110*c*. Similarly, the positioning of the two (2) bores 46 enables one (1) temperature sensor to be placed in the upper ram end zone 110*f*, and one (1) temperature sensor to be placed in the lower ram end zone 110*e*. In this embodiment, the temperature sensors are thermocouples. The temperature sensors feed into the controller, providing the operator with temperature data from which subsequent temperature adjustments can be made. As will be appreciated, the positioning of temperature sensors located in bores 44 and 46 both above and below the liner 24 advantageously allows the vertical temperature profile across the liner 24 to be measured, and moreover allows any vertical temperature difference that arises during extrusion to be monitored by the operator.

Additionally, the positioning of the bore 48 enables one (1) temperature sensor to be placed in the upper ram end zone 110*f* in proximity to the first fluid channel 52, and one (1) temperature sensor to be placed in the upper die end zone 110*d* in proximity to the second fluid channel 54. In this embodiment, these temperature sensors are also thermocouples that feed into the controller, providing the operator with temperature data from which subsequent temperature adjustments can be made. As will be appreciated, the positioning of temperature sensors in bore 48 in proximity to each of the first fluid channel 52 and the second fluid channel 54 allows the cooling provided by each of the first and second fluid channels 52 and 54 to be directly monitored. Moreover, the proximity of the temperature sensors in bore 48 to each of the first and second fluid channels 52 and 54 allows temperature changes resulting from adjustment to the flow rate of either the first fluid or the second fluid to be observed quickly after such flow rate adjustments are made.

During operation, temperature data output from the temperature sensors is monitored by the operator. The position of the second fluid channel 54 advantageously allows any temperature increase within the upper die end zone 110*d* to be reduced or eliminated by increasing the second fluid flow rate therethrough. As will be understood, second fluid provided by the second fluid supply line enters the first end 86 of the tubing 84 via the second input port of the fluid manifold 92. As the second fluid travels along the length of the tubing to the second end 88, heat is transferred from the mantle 22 to the flowing second fluid. The second fluid exits from the second fluid channel 54 via the output port and enters the discharge 98. As will be appreciated, the transfer of heat from the mantle 22 to the flowing second fluid results in a temperature reduction within the upper die end zone 110*d* of the container 20.

The position of the elongate heating elements also advantageously allows any temperature increase within the upper die end zone 110*d* to be reduced or eliminated by reducing the thermal energy supplied by heating elements 108 positioned above the liner 24. Thus, as each of the heating elements are individually controllable, and as the flow rate of second fluid through the second fluid channel 54 is also controllable, the thermal profile across the liner 24 and within the container 20 adjacent the die end 34 can be accurately controlled. As will be understood, one or both of control of the second fluid flow rate through the second fluid channel 54, and control of the thermal energy supplied by the heating elements, may be used to control the thermal profile across the liner 24 and within the container 20 adjacent the die end 34.

Similarly, the position of the first fluid channel 52 advantageously allows any temperature increase within the upper ram end zone 110*f* to be reduced or eliminated by increasing the first fluid flow rate therethrough. As will be understood, first fluid provided by the pressurized first fluid supply line enters the first end 60 of the first circumferential groove 56 via the first input port 68 of the fluid manifold 66. As the fluid travels along the length of the first circumferential groove 56 to the second end 62, heat is transferred from the mantle 22 to the flowing fluid. The fluid exits from the first fluid channel 52 via the output port 76 and enters the exhaust line 78. As will be appreciated, the transfer of heat from the mantle 22 to the flowing first fluid results in a temperature reduction within the upper ram end zone 110*f* of the container 20.

The position of the elongate heating elements also advantageously allows any temperature increase within the upper ram end zone 110*f* to be reduced or eliminated by reducing the thermal energy supplied by heating elements 108 positioned above the liner 24. Thus, as each of the heating elements are individually controllable, and as the flow rate of first fluid through the first fluid channel 52 is also controllable, the thermal profile across the liner 24 and within the container 20 adjacent the ram end 40 can be accurately controlled. As will be understood, one or both of control of the first fluid flow rate through the first fluid channel 52, and control of the thermal energy supplied by the heating elements, may be used to control the thermal profile across the liner 24 and within the container 20 adjacent the ram end 40.

As will be appreciated, the use of two (2) separate heat sinks, namely the first fluid channel 52 and the second fluid channel 54, advantageously allows the temperature profile at the ram end of the container 20 to be controlled separately from the temperature profile at the ram end of the container 20. As will be understood, this provides better control of the temperature profile within the container as a whole, as compared to conventional containers having only a single heat sink.

As will be appreciated, the use of water as the second fluid advantageously enables heat to be removed more quickly from the upper die end zone 110*d*, as compared to the rate of heat removal from the upper ram end zone 110*f* where air is used as the first fluid. As will be understood, the thermal conductivity and isochoric specific heat ($c_V$) of water at 20° C. is 0.6 (W/m·K) and 4.15 (kJ/kg·K), respectively, while the thermal conductivity and isochoric specific heat ($c_V$) of air at 20° C. is 0.026 (W/m·K) and 0.7178 (kJ/kg·K), respectively. As a result, any temperature change observed in the die end zone 110*a* during extrusion can be more quickly controlled through adjustment of the second fluid flow rate, as compared to conventional containers.

Figure 10:
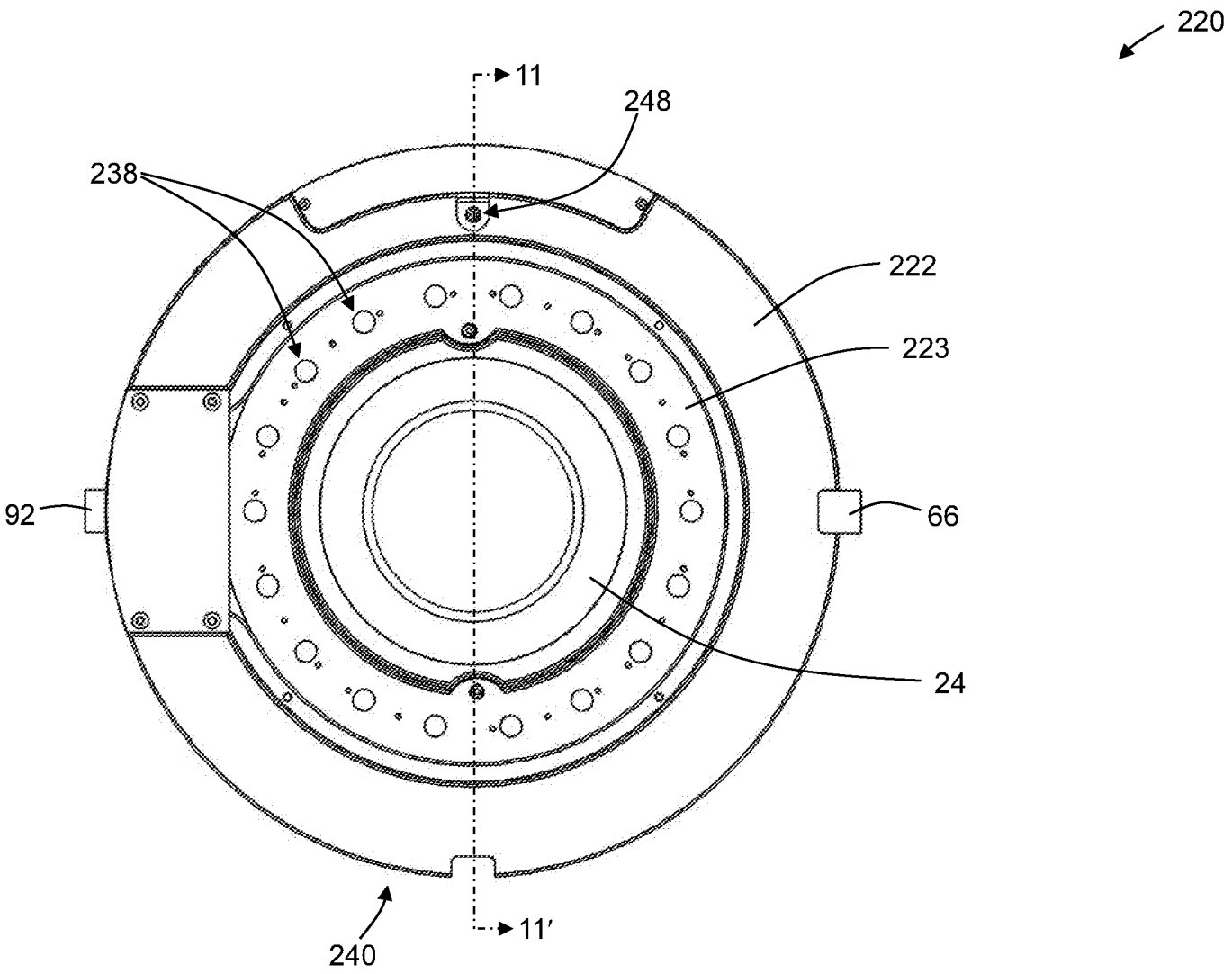
FIG. 10 is an end view of another embodiment of a container for use with the metal extrusion press of FIG. 1.
Figure 11:
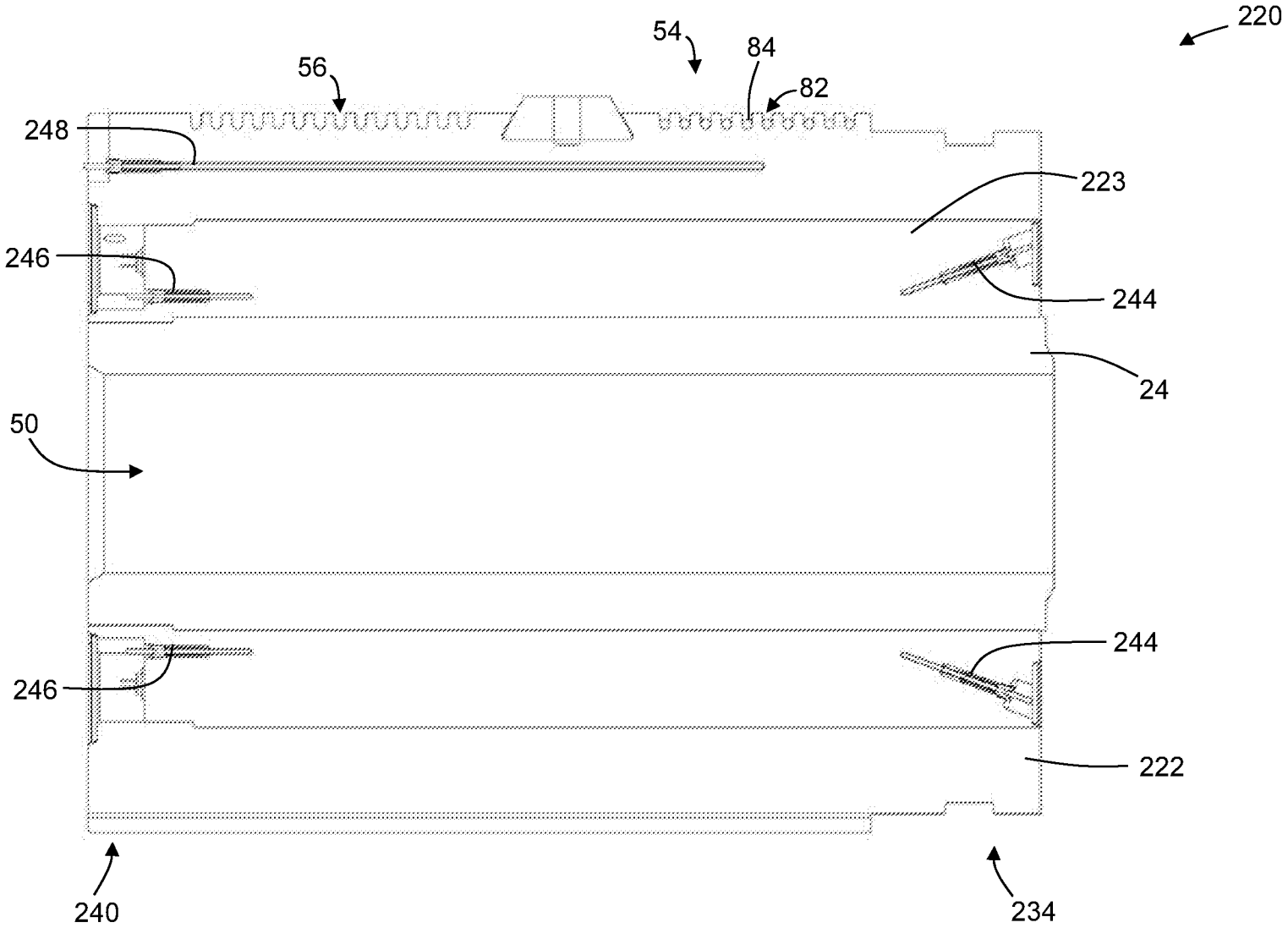
FIG. 11 is a sectional view of the container of FIG. 10, taken along the indicated section line.

In other embodiments, the container may be differently configured. For example, FIGS. 10 and 11 show another embodiment of a container for use with the extrusion press of FIG. 1, and which is generally indicated by reference numeral 220. Container 220 has an outer mantle 222 that surrounds a subliner 223, which in turn surrounds the inner tubular liner 24.

Similar to container 20 described above and with reference to FIGS. 2 to 8, the container 220 is configured at its die end 234, and along the side sections thereof, in a manner known in the art to facilitate coupling of the container 220 to the extrusion press. The mantle 222 has a generally cylindrical shape and comprises an axial bore accommodating the subliner 223. The subliner 223, in turn, comprises an axial bore, for accommodating the liner 24. In this embodiment, the mantle 222, the subliner 223 and the liner 24 are shrunk-fit together.

The subliner 223 comprises a plurality of longitudinal bores 238 extending from a ram end 240 of the subliner 223 to the die end 34 of the subliner 223, and surrounding the liner 24. Each longitudinal bore 238 is shaped to accommodate an elongate heating element 108, which can be energized to provide thermal energy to the subliner 223 in the vicinity of the liner 24 during use.

The subliner 223 also comprises a plurality of bores 244 and 246 adjacent the liner 24 and extending partially into the length of the subliner 223. In this embodiment, the subliner 223 comprises two (2) bores 244 extending from the die end 234 approximately four (4) inches into the subliner 223, and two (2) bores 246 extending from the ram end 240 approximately four (4) inches into the subliner 223. Each bore 244 and 246 is shaped to accommodate a temperature sensor (not shown). The bores 244 and 246 are positioned in a manner so as to avoid intersecting any of the longitudinal bores 238 configured for accommodating the heating elements. In this embodiment, one (1) of the bores 244 is positioned above the liner 24 while the other bore 244 is positioned below the liner 24, and one (1) of the bores 246 is positioned above the liner 24 while the other bore 246 is positioned below the liner 24.

The mantle 222 comprises a longitudinal bore 248 in an upper portion of the mantle, radially outward of the nearest longitudinal bore configured for accommodating a heating element. The bore 248 extends from the ram end 40 approximately sixteen (16) inches into the mantle 222, or approximately two thirds (⅔) the length of the mantle 222. The bore 248 is sized to accommodate two (2) temperature sensors (not shown), each of which is positioned in proximity to a respective heat sink, described below.

The container 220 also comprises two (2) heat sinks that are configured for cooling the container 220. In this embodiment, the heat sinks comprise the first fluid channel 52 adjacent the ram end 240 of the container 220, and the second fluid channel 54 adjacent the die end 234 of the container 220. As described above and with reference to FIGS. 2 to 8, the first fluid channel 52 and second fluid channel 54 are separate, and are not in fluid communication with each other.

The first fluid channel 52 comprises the first circumferential groove 56 formed in an upper portion of the outer surface of the mantle 222 adjacent the ram end 240, and a cover plate 58 sized to cover the first circumferential groove 56. The first circumferential groove 56 has the first end 60 and the second end 62, and defines a serpentine path between the first and second ends 60 and 62. The first circumferential groove 56 is formed such that at least a majority of its length is formed in the upper half of the mantle 222, and in the embodiment shown the entirety of the first circumferential groove 56 is formed in the upper half of the mantle 222. Additionally, the first circumferential groove 56 is formed such that at least a majority of its length is formed in the half of the mantle 222 at the ram end 40, and in the embodiment shown the entirety of the first circumferential groove 56 is formed in the half of the mantle 222 at the ram end 240. When the cover plate 58 is installed so as to cover the first circumferential groove 56, the first fluid channel 52 provides a generally enclosed, continuous channel through which a first fluid flows to cool the container 220.

The first fluid channel 52 is in fluid communication with a supply 64 of pressurized first fluid via a first longitudinal fluid manifold 66 mounted to a first side of the mantle 222. The manifold 66 comprises the first fluid input port 68 that is in fluid communication with the first end 60 of the first circumferential groove 56, and that is also in fluid communication with the supply 64 of pressurized first fluid via the supply line 72. The first fluid is a gas, and in this embodiment the first fluid is air. A first flow rate control apparatus 74 is connected to the supply 64 of pressurized first fluid and/or the supply line 72, and is configured to allow the flow rate of first fluid entering the first fluid input port 68 to be controlled by the operator. The manifold 66 also comprises a first fluid output port 76 that is in fluid communication with the second end 62 of the first circumferential groove 56, and which is in fluid communication with the exhaust line 78.

The second fluid channel 54 comprises the second circumferential groove 82 formed in the upper portion of the outer surface of the mantle 222 adjacent the die end 234 of the container 220, and continuous tubing 84 sized to be accommodated within the second circumferential groove 82. In the example shown, the second circumferential groove 82 is a continuous groove that defines a serpentine path. The tubing 84 has the first end 86 and the second end 88, and is disposed in the second circumferential groove 82 to define a serpentine path between the first and second ends 86 and 88. Similar to the first circumferential groove 56, the second circumferential groove 82 is configured such that at least a majority of the length of the tubing 84 is disposed in the upper half of the mantle 222, and in the embodiment shown the entirety of the length of the tubing 84 is disposed in the upper half of the mantle 222. Additionally, the first circumferential groove 56 is formed such that at least a majority of its length is formed in the half of the mantle 222 at the die end 234, and in the embodiment shown the entirety of the first circumferential groove 56 is formed in the half of the mantle 222 at the die end 234. The tubing 84 is configured to convey a second fluid therethrough to cool the container 220.

The second fluid channel 54 is in fluid communication with the supply 90 of pressurized second fluid via the second longitudinal fluid manifold 92 mounted to a second side of the mantle 222. The manifold 92 comprises a second fluid input port (not shown) that is in fluid communication with the first end 86 of the tubing 84, and that is also in fluid communication with the supply 90 of second fluid via the supply line 94. In this embodiment, the second fluid is water. A second flow rate control apparatus 96 is connected to the supply of second fluid and/or the supply line, and is configured to allow the flow rate of second fluid entering the manifold 92 to be controlled by the operator. The manifold 92 also comprises a second fluid output port (not shown) that is in fluid communication with the second end 88 of the continuous tubing 84, and which is in fluid communication with the second fluid discharge 98. In this embodiment, the second fluid discharge 98 is a drain.

During operation, temperature data output from the temperature sensors is monitored by the operator. The position of the second fluid channel 54 advantageously allows any temperature increase within the upper die end zone 110*d* to be reduced or eliminated by increasing the second fluid flow rate therethrough. As will be understood, second fluid provided by the second fluid supply line enters the first end of the tubing 84 via the second input port of the fluid manifold 92. As the second fluid travels along the length of the tubing to the second end 88, heat is transferred from the mantle 222 to the flowing second fluid. The second fluid exits from the second fluid channel 54 via the output port and enters the discharge 98. As will be appreciated, the transfer of heat from the mantle 222 to the flowing second fluid results in a temperature reduction within the upper die end zone 110*d* of the container 220.

The position of the elongate heating elements also advantageously allows any temperature increase within the upper die end zone 110*d* to be reduced or eliminated by reducing the thermal energy supplied by heating elements 108 positioned above the liner 24. Thus, as each of the heating elements are individually controllable, and as the flow rate of second fluid through the second fluid channel 54 is also controllable, the thermal profile across the liner 24 and within the container 220 adjacent the die end 234 can be accurately controlled. As will be understood, one or both of control of the second fluid flow rate through the second fluid channel 54, and control of the thermal energy supplied by the heating elements, may be used to control the thermal profile across the liner 24 and within the container 220 adjacent the die end 234.

Similarly, the position of the first fluid channel 52 advantageously allows any temperature increase within the upper ram end zone 110*f* to be reduced or eliminated by increasing the first fluid flow rate therethrough. As will be understood, first fluid provided by the pressurized first fluid supply line enters the first end 60 of the first circumferential groove 56 via the first input port 68 of the fluid manifold 66. As the fluid travels along the length of the first circumferential groove 56 to the second end 62, heat is transferred from the mantle 222 to the flowing fluid. The fluid exits from the first fluid channel 52 via the output port 76 and enters the exhaust line 78. As will be appreciated, the transfer of heat from the mantle 222 to the flowing first fluid results in a temperature reduction within the upper ram end zone 110*f* of the container 220.

The position of the elongate heating elements also advantageously allows any temperature increase within the upper ram end zone 110*f* to be reduced or eliminated by reducing the thermal energy supplied by heating elements 108 positioned above the liner 24. Thus, as each of the heating elements are individually controllable, and as the flow rate of first fluid through the first fluid channel 52 is also controllable, the thermal profile across the liner 24 and within the container 220 adjacent the ram end 240 can be accurately controlled. As will be understood, one or both of control of the first fluid flow rate through the first fluid channel 52, and control of the thermal energy supplied by the heating elements, may be used to control the thermal profile across the liner 24 and within the container 220 adjacent the ram end 240.

It will be understood that the liner is not limited to the configuration described above, and in other embodiments, the liner may alternatively have other configurations. For example, the liner may alternatively comprise a billet receiving passage having a generally rectangular cross-sectional profile that may comprise any of flared ends, rounded corners, and rounded sides, as described in U.S. Pat. No. 9,975,160 issued on May 22, 2018, entitled "EXTRUSION PRESS CONTAINER AND LINER FOR SAME", the content of which is incorporated by reference herein in its entirety.

In still other embodiments, the container may be differently configured. For example, in other embodiments, the first fluid channel may alternatively be configured identically to the second fluid channel, such that the first fluid channel also comprises continuous tubing accommodated within the first circumferential groove formed in the upper portion of the outer surface of the mantle adjacent the ram end of the container, with the continuous tubing being configured to convey the first fluid therethrough to cool the container, with the first fluid also being water instead of air. In such an embodiment, the first fluid channel would be in fluid communication with the supply of water via a suitable supply line, and with a water flow rate control apparatus is connected to the water supply and/or the water supply line. Thus, in such an embodiment, both the first fluid channel and the second fluid channel would be configured to convey separately adjustable circuits of water to cool different ends of the container.

Although in the embodiments described above, the longitudinal bores for the elongate heating elements extend the length of the mantle or subliner, in other embodiments, the longitudinal bores for the elongate heating elements may alternatively extend only partially the length of the mantle or subliner. For example, in one embodiment, the longitudinal bores may alternatively extend from the ram end of the mantle or subliner to approximately one-half (0.5) inches from the die end of the mantle or subliner.

Although in the embodiments described above, each fluid channel comprises a circumferentially-oriented, serpentine groove formed in the upper portion of the outer surface of the mantle, in other embodiments, one or both grooves may have other configurations. For example, in other embodiments, one or both grooves fluid channels may alternatively comprise a longitudinally-oriented, serpentine groove formed in the upper portion of the outer surface of the mantle. Those skilled in the art will understand that still other groove configurations are possible. Additionally, the grooves need not necessarily be serpentine, and in other embodiments, one or both grooves may alternatively have a non-serpentine configuration.

Although in the embodiments described above, the longitudinal bores for the elongate heating elements extend the length of the mantle or subliner, in other embodiments, the longitudinal bores for the elongate heating elements may alternatively extend only partially the length of the mantle or subliner. For example, in one embodiment, the longitudinal bores may alternatively extend from the ram end of the mantle or subliner to approximately one-half (0.5) inches from the die end of the mantle or subliner.

Although in the embodiments described above, the elongate heating elements are configured with die end heating sections and ram end heating sections, in other embodiments, the elongate heating elements may alternatively be configured with additional or fewer heating sections, and/or may alternatively be configured to heat along the entire length of the heating cartridge.

Although in the embodiments described above, the elongate heating elements in the vicinity of the lower die end zone and the lower ram end zone are described as being configured to be controlled by the operator to provide added temperature, it will be understood that these elongate heating elements are also configured to be controlled by the operator to provide reduced temperature. Similarly, although in the embodiment described above, the elongate heating elements in the vicinity of the upper die end zone and the upper ram end zone are described as being configured to be controlled by the operator to provide reduced temperature, it will be understood that these elongate heating elements are also configured to be controlled by the operator to provide added temperature.

Although in the embodiments described above, the bores for accommodating temperature sensors extend partially into the length of the mantle or subliner, in other embodiments, the bores may alternatively extend the full length of the mantle or subliner. In related embodiments, the temperature sensors may alternatively be "cartridge" type temperature sensors, and may alternatively comprise a plurality of temperature sensors positioned along their length.

Although in the embodiments described above, the first fluid is air, in other embodiments, one or more other suitable fluids may alternatively be used. For example, in other embodiments, the first fluid may be any of nitrogen and helium. In other embodiments, the first fluid may be cooled by a cooling apparatus prior to entering the first fluid channel.

Although embodiments have been described above with reference to the accompanying drawings, those of skill in the art will appreciate that variations and modifications may be made without departing from the scope thereof as defined by the appended claims.

What is claimed is:

1. A container for use in a metal extrusion press, the container comprising:

a mantle comprising an elongate body having an outer surface and an axial bore therein;

an elongate liner accommodated within the axial bore, the liner comprising a longitudinally extending passage therein through which a billet is advanced;

a first fluid channel on the outer surface of the mantle, the first fluid channel being configured to direct a first fluid therethrough for cooling a first end of the container; and a second fluid channel on the outer surface of the mantle, the second fluid channel being configured to direct a second fluid therethrough for cooling a second end of the container, wherein the first fluid channel and the second fluid channel are separate from each other, and wherein the first fluid and the second fluid are different fluids, and wherein the second fluid channel comprises tubing disposed in a serpentine groove formed on the outer surface of the mantle.

2. The container of claim 1, wherein the second fluid is water.

3. The container of claim 1, wherein the second fluid is water, and the first fluid is air.

4. The container of claim 1, wherein the mantle comprises a plurality of longitudinal bores, each of the longitudinal bores accommodating a respective heating element.

5. The container of claim 4, wherein said heating elements are arranged circumferentially about the axial bore of the mantle.

6. The container of claim 4, further comprising at least one temperature sensor positioned in the mantle adjacent at least one of the first fluid channel and the second fluid channel.

7. The container of claim 6, wherein the at least one temperature sensor is positioned between the longitudinal bores and said at least one of the first fluid channel and the second fluid channel.

8. The container of claim 1, wherein the first fluid channel comprises:

an additional groove disposed on the outer surface of the mantle; and a cover plate covering the additional groove.

9. The container of claim 8, wherein the additional groove is an additional serpentine groove.

10. The container of claim 1, further comprising a manifold configured for one or more of:

delivering fluid to at least one of the first fluid channel and the second fluid channel; and removing fluid from at least one of the first fluid channel and the second fluid channel.

11. The container of claim 1, further comprising a temperature sensor positioned in the mantle adjacent at least one of the first fluid channel and the second fluid channel.

12. A container for use in a metal extrusion press, the container comprising:

a mantle comprising an elongate body having an outer surface and a first axial bore therein;

an elongate subliner accommodated within the first axial bore, the subliner having a second axial bore therein;

an elongate liner accommodated within the second axial bore, the liner comprising a longitudinally extending passage therein through which a billet is advanced;

a first fluid channel on the outer surface of the mantle, the first fluid channel being configured to direct a first fluid therethrough for cooling a first end of the container; and a second fluid channel on the outer surface of the mantle, the second fluid channel being configured to direct a second fluid therethrough for cooling a second end of the container, wherein the first fluid channel and the second fluid channel are separate from each other, and wherein the first fluid and the second fluid are different fluids, and wherein the second fluid channel comprises tubing disposed in a serpentine groove formed on the outer surface of the mantle.

13. The container of claim 12, wherein the subliner comprises a plurality of longitudinal bores, each of the bores accommodating a respective heating element.

14. The container of claim 12, further comprising at least one temperature sensor positioned in the mantle adjacent at least one of the first fluid channel and the second fluid channel.

15. A container for use in a metal extrusion press, the container comprising:

a mantle comprising an elongate body having an outer surface and an axial bore therein;

an elongate liner accommodated within the axial bore, the liner comprising a longitudinally extending passage therein through which a billet is advanced;

a first fluid channel on the outer surface of the mantle, the first fluid channel being configured to direct a first fluid therethrough for cooling a first end of the container; and a second fluid channel on the outer surface of the mantle, the second fluid channel being configured to direct a second fluid therethrough for cooling a second end of the container, wherein only the second fluid channel comprises tubing disposed in a groove on the outer surface of the mantle.

16. The container of claim 15, wherein the second fluid is water.

17. The container of claim 15, wherein the mantle comprises a plurality of longitudinal bores, each of the longitudinal bores accommodating a respective heating element.

18. The container of claim 17, wherein said heating elements are arranged circumferentially about the axial bore of the mantle.

19. The container of claim 17, further comprising at least one temperature sensor positioned in the mantle adjacent at least one of the first fluid channel and the second fluid channel.

20. The container of claim 19, wherein the at least one temperature sensor is positioned between the longitudinal bores and said at least one of the first fluid channel and the second fluid channel.

* * * * *